United States Patent [19]

Kubo et al.

[11] 4,448,746

[45] May 15, 1984

[54] PROCESS FOR PRODUCING ALLOY STEEL POWDER

[75] Inventors: Toshihiko Kubo, Ibaraki; Minoru Ichidate, Ohtsu; Eijiro Tamura, Hirakata; Isamu Karasuno, Yamato-Koriyama; Masahide Umino, Nara, all of Japan

[73] Assignee: Sumitomo Metal Industries, Ltd., Osaka, Japan

[21] Appl. No.: 439,432

[22] Filed: Nov. 5, 1982

[51] Int. Cl.[3] ..... B22F 1/00

[52] U.S. Cl. ..... 419/31; 419/62; 419/63; 148/126.1; 148/16

[58] Field of Search ..... 419/31, 62, 63; 75/0.5 R, 0.5 A; 148/126.1, 16

[56] References Cited

U.S. PATENT DOCUMENTS

| | | | |
|---|---|---|---|
| 2,498,769 | 2/1950 | Ramage | 419/31 |
| 3,668,024 | 6/1972 | Johnson | 419/31 |
| 3,687,654 | 9/1972 | Huseby | 419/31 |
| 3,725,142 | 4/1973 | Huseby | 148/16 |
| 3,887,402 | 6/1975 | Kondo et al. | 148/126 |
| 4,124,377 | 11/1978 | Larson | 75/0.5 C |

OTHER PUBLICATIONS

Jenkins; *Controlled Atmospheres for the Heat Treatment of Metals*; 1946; pp. 276–278.

*Primary Examiner*—Brooks H. Hunt

*Attorney, Agent, or Firm*—Burns, Doane, Swecker & Mathis

[57] ABSTRACT

A process for producing alloy steel powder, particularly, low-oxygen, low-carbon alloy steel powder is disclosed. The process comprises: preparing molten steel which contains at least one easily oxidizable element selected from the group consisting of chromium, manganese, vanadium, niobium, boron and silicon; atomizing said molten steel by means of an atomizing agent containing a non-oxidizing medium to provide as-atomized alloy steel powder containing 0.2% by weight or less of oxygen and 0.1% by weight or more of carbon; decarburizing the resulting powder by maintaining it in an atmosphere containing at least $H_2$ and $H_2O$ gases under specified conditions; and cooling the thus decarburized alloy steel powder to room temperature in an inert or reducing atmosphere.

17 Claims, 9 Drawing Figures

PROCESS FOR PRODUCING ALLOY STEEL POWDER

BACKGROUND OF THE INVENTION

This invention relates to a process for producing alloy steel powder, particularly to a process for producing low-oxygen, low-carbon alloy steel powder, in which the oxidation of easily oxidizable elements, such as chromium, manganese, etc. has been suppressed effectively.

Conventional processes for producing steel powder include water atomization, gas atomization and oil atomization. They are all well known in the art. However, they all present problems as mentioned hereinafter when they are used for producing alloy steel powder which contains easily oxidizable elements such as mentioned above:

Water Atomization

This process employs water as an atomizing agent. Therefore, the contamination of the resulting powder with oxides is inevitable during atomization. The formation of oxides is so great that the addition of easily oxidizable elements to an alloy system should be restricted. Thus, in designing the alloy, the addition of easily oxidizable elements is limited.

More particularly, when molten steel containing easily oxidizable elements such as chromium (Cr), manganese (Mn), vanadium (V), niobium (Nb), boron (B), silicon (Si), etc. is subjected to water atomization, these elements are oxidized, and reduction of the thus oxidized steel powder will have to be carried out at a succeeding step to lower the oxygen level of the powder. However, it is extremely difficult to reduce the proportion of oxygen in steel to a practical level, and it requires complicated processing.

For example, if, by specifically adjusting the atomizing conditions and atmosphere, the oxygen level of as-atomized powder is made as low as 0.5% by weight, it is necessary to treat the as-atomized powder at a temperature higher than 1150° C. for five hours or longer so as to obtain powder having a practical level of oxygen. However, after such long time high temperature treatment, the resulting powder having the intended level of oxygen is sintered and requires a heavy duty disintegration step. And, when such a strong disintegration process is applied to the powder, the shape and size of the resulting powder particles will differ very much from those of the as-atomized powder, and their compressibility, compactibility and sintering applicability will be impaired.

Another method of deoxidization of atomized powder has been proposed, in which a substantial amount of carbon is intentionally added to the molten steel prior to the water atomization. In this method the resulting atomized powder contains a relatively large amount of carbon as a reducing agent, which serves to remove the oxygen contained in the atomized powder in accordance with the reaction shown by the formula: $C+O \rightarrow CO$ upon heating at a high temperature in vacuo. However, this method also requires heating of the powder at a temperature higher than 1100° C. for a long period of time in order to reduce the amount of oxygen, resulting in the same problems as mentioned in the above. In addition, since this method essentially requires the presence of carbon in a predetermined amount in atomized powder, the apparatus and operation therefor become very complicated making this method less practical.

Gas Atomization

This is a process for producing steel powder by utilizing an inert gas such as $N_2$, Ar, etc. as an atomizing agent. This method results in less contamination with oxides. However, with gas cooling the cooling rate of the atomized powder is small, and the resulting particles tend to become round. Round particles are difficult to compact. It is, therefore, necessary to compact such powder by means of canning compaction techniques through cold (or hot) isostatic pressing etc. However, the compaction of this type is very complicated and is costly, so this method is not often used.

Furthermore, with gas atomization a large volume of gas is required, so the operating cost of this method is 10 times that of the water atomization process.

Thus, though the gas atomization method is practiced for special purposes, it is rarely used for the production of steel powder to be sintered or sintered-forged, which is the major application in the field of powder metallurgical technology.

Oil Atomization

In this process for producing steel powder oil is used as the atomizing agent. This process is superior to water atomization in that the oxidation of steel powder does not occur, i.e. the oxidation of alloying elements does not occur. However, carburization of the resulting powder, i.e. diffusion of carbon from the oil to the powder occurs during atomization, and decarburization has to be carried out at a succeeding step.

If the alloy steel powder contains easily oxidizable elements such as Cr, Mn, V, Nb, B, Si, etc., it is easier to carry out decarburization than to carry out reduction on once oxidized steel powder. However, up to now to process has been proposed for carrying out decarburization in an efficient and continuous manner.

As a decarburizing gas $H_2$, $H_2O$, $CO$-$CO_2$, etc. are known in the art. Of them $H_2$ gas is not practical, because the decarburizing rate with $H_2$ gas is very low. On the other hand, although a decarburizing gas which contains an oxidizing gas, such as $H_2O$, $CO_2$, etc. can remarkably accelerate the decarburization, the oxidation of an element, such as Cr, Mn, V, Nb, B, Si, etc. is inevitable under the decarburizing temperature and atmospheric conditions under which the decarburization proceeds, because such conditions put these elements in an oxidizing region defined by thermodynamic equilibrium conditions. Therefore, special care is necessary to control the decarburizing conditions.

For the above reasons decarburization of oil atomized alloy steel powder has not yet been worked out. The inventors of this invention have been unable to find any report on the decarburization of alloy steel powder containing Cr, Mn, V, Nb, B, Si, etc., which are thought to be easily oxidized in view of their equilibrium conditions, and being comprised of finely divided particles which are very easily oxidized because of its particulate form.

OBJECTS OF THIS INVENTION

Therefore, one of the objects of this invention is to provide a process for producing low-oxygen, low-carbon alloy steel powder by utilizing oil-atomization, in which the oxidation of easily oxidizable elements such as Cr, Mn, V, Nb, B, Si, etc. is effectively suppressed during decarburization.

Another object of this invention is to provide a process for producing alloy steel powder containing one or more of the easily oxidizable elements of Cr, Mn, V, Nb, B and Si, which contains carbon in an amount of 0.1% by weight or less and oxygen in an amount of 0.2% by weight or less.

Still another object of this invention is to provide a process for continuously producing alloy steel powder through decarburization of oil-atomized alloy steel powder in a continuous manner.

SUMMARY OF THE INVENTION

Figure 1:
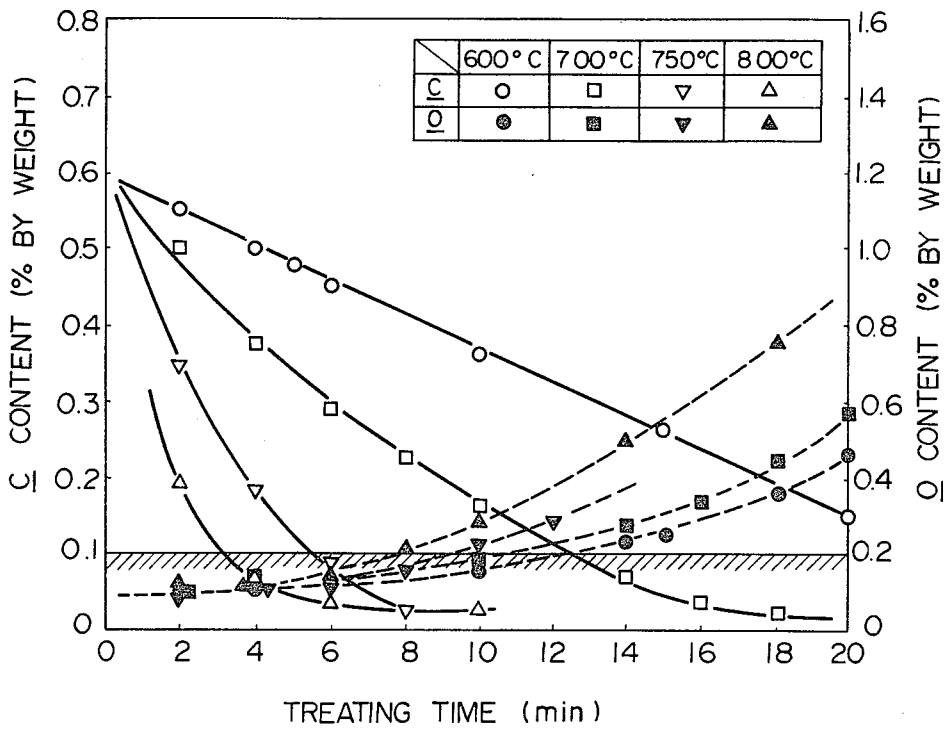
FIG. 1 is a graph showing the relationship between decarburizing temperature and changes in carbon and oxygen content of steel powder with respect to treating period of time.
Figure 3:
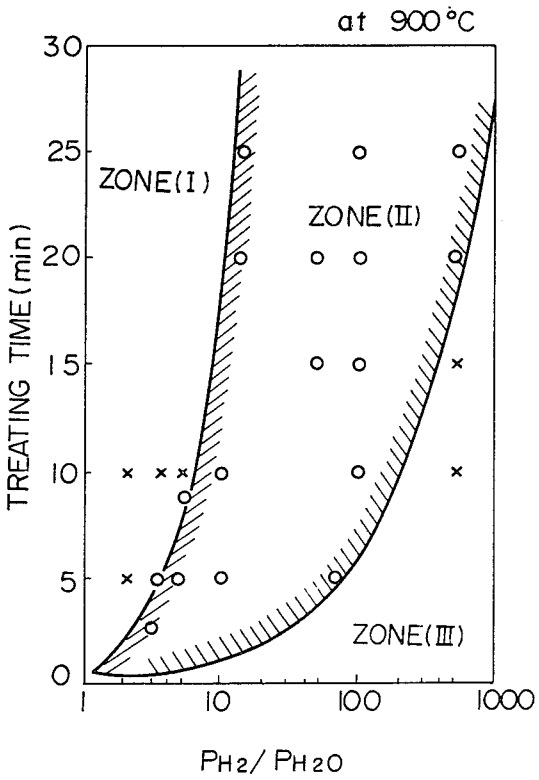
FIGS. 2–7 are graphs showing the relationship between the $P_{H2}/P_{H2O}$ ratio of the atmosphere and the treating time at the indicated temperatures, respectively, to illustrate the criticality of decarburizing conditions of this invention.
Figure 2:
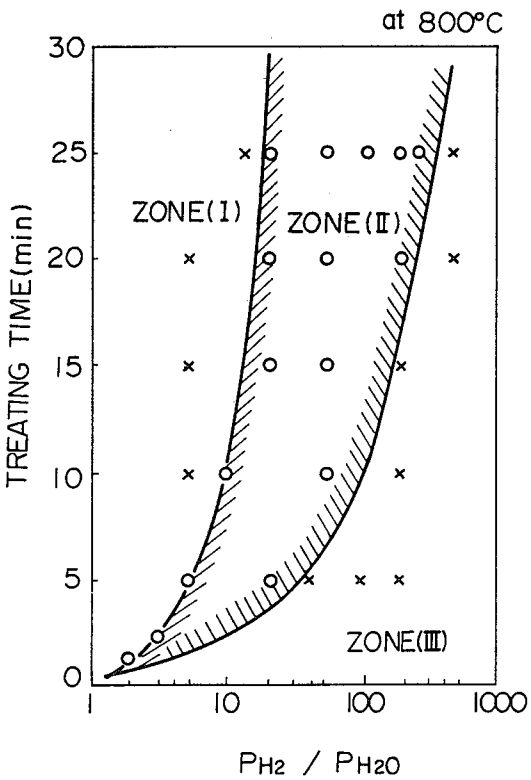
Figure 5:
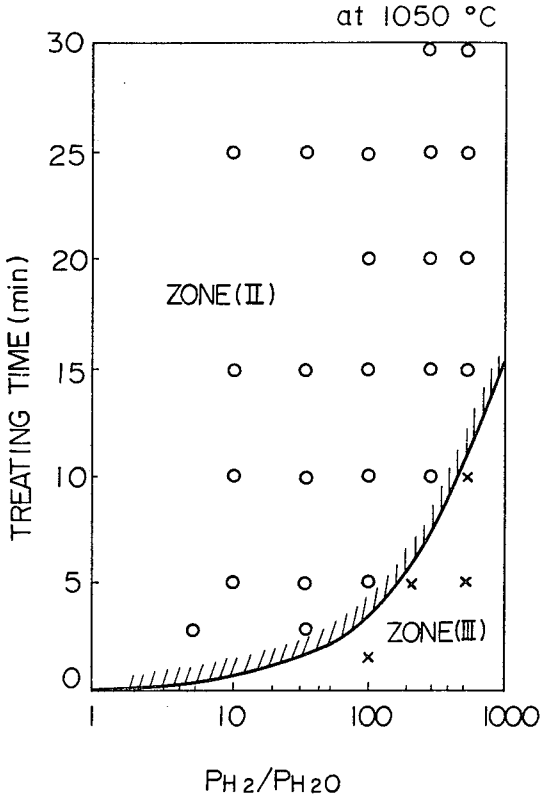
Figure 4:
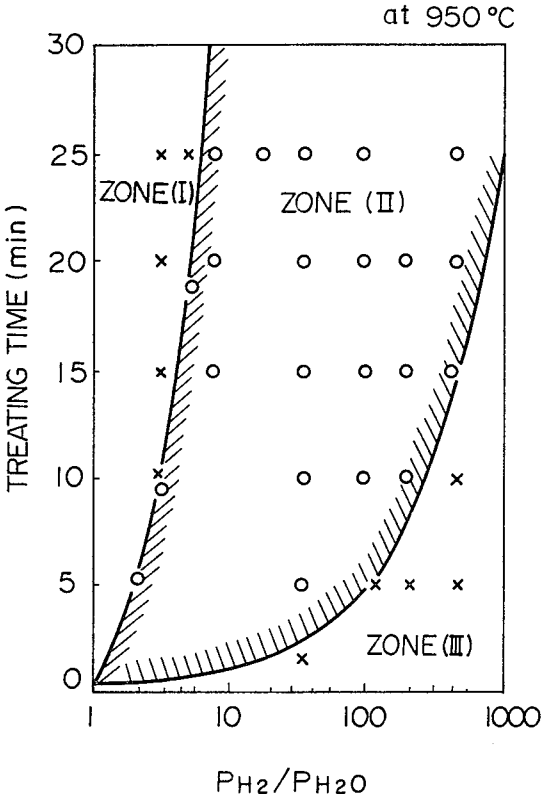
Figure 7:
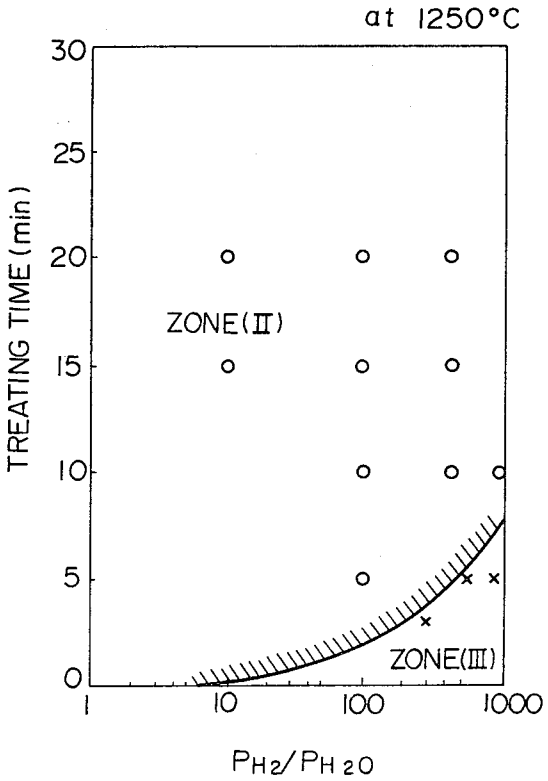
Figure 6:
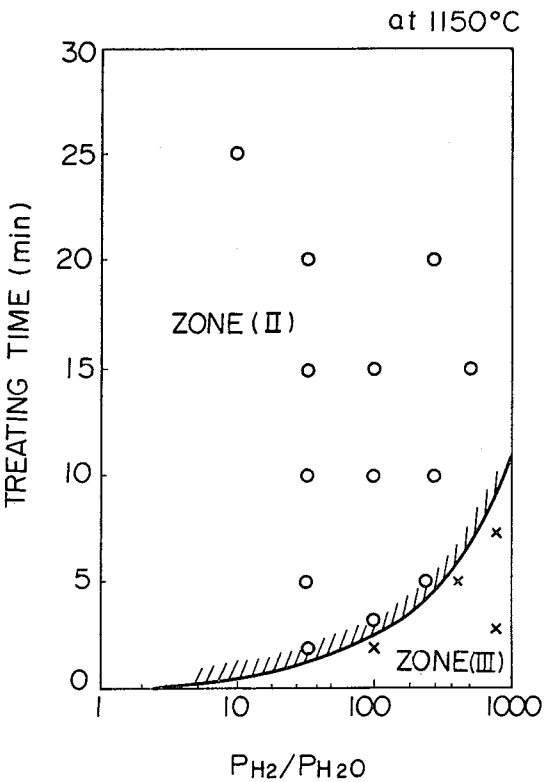

The inventors of this invention found that it is possible to produce low-oxygen, low-carbon alloy steel powder by obtaining as-atomized alloy steel powder containing oxygen in an amount as small as 0.2% by weight or less and a relatively large amount of carbon through oil-atomization, and then finishing the succeeding decarburization before oxidation of the above mentioned easily oxidizable elements is initiated.

The inventors of this invention also found that the decarburization can effectively be carried out when specific decarburizing conditions are set under which the oxidation of easily oxidizable elements is kept to as low a degree as possible, and the inventors reached this invention.

This invention resides in a process for producing low-oxygen, low-carbon alloy steel powder, which comprises the steps of:

preparing molten steel which contains at least one easily oxidizable element selected from the group consisting of chromium, manganese, vanadium, niobium, boron and silicon;

atomizing said molten steel by means of an atomizing agent containing a non-oxidizing medium, preferably a non-oxidizing medium selected from mineral oils, animal oils or vegetable oils to provide as-atomized alloy steel powder containing 0.2% by weight or less of oxygen and 0.1% by weight or more of carbon;

adjusting the amount of carbon of said as-atomized steel powder by maintaining it in an atomosphere containing at least $H_2$ and $H_2O$ gases under either of the below-defined conditions (A) or (B); and cooling the thus obtained alloy steel powder to room temperature in an inert or reducing atmosphere.

Condition (A):

Temperature (t°C.): 600° C.≦t≦950° C.

Atmosphere ($P_{H2}/P_{H2O}$): $0.5 \leqq P_{H2}/P_{H2O} \leqq 1000$

Treating Time ($\theta$ minute):

$$1.1 \times 10^{-3} \exp\left[\left(\frac{13126}{1.987(t+273)}\right)\left(\frac{P_{H2}}{P_{H2O}}\right)^{0.667}\right] \leqq$$

$$\theta \leqq \{0.101 \div (1.0 - 1.0038 \times 10^{-3}t)\}\left(\frac{P_{H2}}{P_{H2O}}\right)^{1.341}$$

Condition (B):

Temperature (t°C.): 950° C.<t≦1250° C.

Atmosphere ($P_{H2}/P_{H2O}$): $P_{H2}/P_{H2O} \geqq 0.5$

Treating Time ($\theta$ minute):

$$\theta \geqq 1.1 \times 10^{-3} \exp\left(\frac{13126}{1.987(t+273)}\right)\left(\frac{P_{H2}}{P_{H2O}}\right)^{0.667}$$

This invention also resides in a process for producing low-oxygen, low-carbon alloy steel powder, which comprises the steps of:

preparing molten steel which contains at least one easily oxidizable element selected from the group consisting of chromium, manganese, vanadium, niobium, boron and silicon;

atomizing said molten steel by means of an atomizing agent containing a non-oxidizing medium to provide as-atomized alloy steel powder containing 0.2% by weight or less of oxygen and 0.1% by weight or more of carbon;

continuously passing said as-atomized alloy steel powder through an atmosphere containing at least $H_2$ and $H_2O$ gases under either of the above-defined conditions (A) or (B) to adjust the amount of carbon of said as-atomized alloy steel powder; and cooling the thus obtained alloy steel powder to room temperature in an inert or reducing atmosphere.

Thus, in one aspect, this invention is characterized in that the oil-atomized alloy steel powder is subjected to a carbon-adjusting step in an atmosphere containing $H_2O$ and $H_2$ gases under either of said conditions (A) or (B), and then is cooled to room temperature in an inert or reducing atmosphere. The "$P_{H2}$" means a partial pressure of hydrogen gas and the "$P_{H2O}$" means that of steam.

DETAILED DESCRIPTION OF PREFERRED EMBODIMENTS

The reasons for defining the process steps of this invention as in the above will be described hereinafter.

Regarding the step of preparing molten steel, the preparation of molten steel may be carried out in any conventional manner, and is not limited to a specific one. Since the molten steel of this invention process contains at least one easily oxidizable element selected from Cr, Mn, V, Nb, B and Si, the preparation of molten steel is preferably carried out in such way that the oxidation of these elements is suppressed as thoroughly as possible.

In the atomizing step of this invention, as in the conventional oil atomization, an atomizing agent which preferably contains a medium selected from mineral oils, animal oils, vegetable oils and mixtures thereof may be employed. Preferably, according to this invention a non-oxidizing medium comprised of an oil selected from the above-mentioned oils may be employed as an atomizing agent. An oxidizing agent such as water may be incorporated in the atomizing agent so long as the resulting medium is non-oxidizing in nature as a whole.

The oils employed in this invention include machine oil, quench oil, turbine oil, whale oil, rapeseed oil, soybean oil, etc.

The oxygen content of the atomized steel powder obtained in accordance with this invention is restricted to 0.2% by weight or less. It may be 0.1% by weight or less, preferably 0.05% by weight or less. This is because substantially all the oxygen of the atomized powder remains in the final decarburized powder, though deoxidization to some extent can be effected during the following decarburization step. The lower the oxygen content the better. It is to be noted that it is possible to reduce the amount of oxygen significantly by effecting the deoxidization of molten steel prior to atomization, and by preventing oxidation thereafter, particularly by preventing oxidation of the molten steel as well as atomized powder during atomization. The carbon content of the thus obtained atomized steel powder is 0.1% by weight or more. Such a large amount of carbon comes from carburization of the atomizing agent.

The thus obtained high carbon alloy steel powder is then passed to the decarburization step of this invention, where it is subjected to decarburizing conditions defined by either of Conditions (A) or (B), which will be detailed hereinafter.

An atmosphere under which alloy steel powder containing 0.1% by weight or more of carbon can decarburized to a level of less than 0.1% by weight will be considered. It will easily be thought of to add as large an amount of $H_2O$ gas as possible, which are easily reacted with carbon in steel, in order to effect the decarburization of the alloy steel powder. However, the addition of a large amount of oxidizing gas results in the oxidation of such easily oxidizable elements such as Cr, Mn, V, Nb, B, Si, etc., which react more easily with oxygen than Fe. On the other hand, without the addition of such oxidizing gas, substantial decarburization does not occur and a relatively long period of time will be required for processing the powder.

The inventors of this invention noted that though dry hydrogen gas does not exhibit decarburizing effect, the addition of moisture accelerates the decarburizing reaction. However, as mentioned hereinbefore, steam itself is oxidative of these oxidizable elements, so mere addition of steam means that decarburization as well as oxidation will occur.

The inventors of this invention found that when the ratio of partial pressure of hydrogen to partial pressure of steam in an atmosphere containing hydrogen and steam is suitably adjusted, efficient decarburization takes place without resulting in substantial oxidation of the before-mentioned easily oxidizable elements or Fe, and the inventors carried out a series of experiments to determine critical conditions thereof to arrive at this invention.

FIG. 1 is a graph summarizing the experimental data of a series of decarburizing tests with respect to decarburizing temperature. In this series of tests, Cr-Mn low alloy steel powder (Cr: 1.0% by weight; Mn: 1.5% by weight; C: 0.6% by weight; oxygen: 0.09% by weight), which was obtained by the conventional oil-atomization, was packed into a stainless steel boat to a depth of 3 mm. The atmosphere comprised $H_2$, $H_2O$ and $N_2$, the ratio of $P_{H2}/P_{H2O}$ was 33.3 and $P_{H2}$ was 70% of the total pressure of the atmosphere. The boat was heated under the atmosphere to effect decarburization. Changes in the amounts of carbon in powdered steel (C) and oxygen in powdered steel (O) were determined with respect to treating period of time at the indicated temperature.

From the data shown in FIG. 1, it is apparent that decarburization takes place efficiently as the temperature of the atmosphere goes up. It is to be noted, however, that oxidation also takes place. Namely, according to the test results shown in FIG. 1, it may be said that it is possible to reduce the proportion of carbon to 0.1% by weight or less in a short period of treating time. No significant degree of oxidation occurs. In addition, decarburization proceeds rapidly as the temperature of the atmosphere increases, but oxidation does not proceeds so quickly as decarburization. Thus, it is concluded that it is an efficient treatment to employ relatively high temperature and short treating time.

Next, sample steel powder the steel composition and particle size distribution of which are shown in Table 1 was packed into a stainless steel boat to a depth of 20 mm, then heated and maintained at the indicated temperatures under predetermined atmosphere to effect decarburization. The decarburized powder was then cooled to room temperature in a dry hydrogen atmosphere.

The test results of the series of experiments are summarized in graph in FIGS. 2–7 at the indicated temperatures respectively.

The numbers on the abscissa indicate the $P_{H2}/P_{H2O}$ ratio, and the treating time is on the vertical axis. The symbol "O" indicates the case in which the carbon content has been reduced to 0.1% by weight or less and the oxygen content to 0.2% by weight or less. The symbol "X" shows the case where the target values of carbon or oxygen content were not attained. Zone (I) shows the area where the oxidation occurs, Zone (II) shows the area of this invention and Zone (III) shows the area where decarburization is insufficient.

As is apparent from the series of graphs shown in FIGS. 2–7, the ratio of $P_{H2}/P_{H2O}$, temperature and treating time have their own criticality.

The critical range of each of these processing factors: $P_{H2}/P_{H2O}$ ratio, temperature (t°C.) and treating time ($\theta$ min) can be derived on the basis of the data given in FIGS. 2–7 as follows (wherein the treating time, $\theta$, is a function of $P_{H2}/P_{H2O}$):

The minimum treating time required to reduce the carbon content to 0.1% by weight or less at a temperature of 600°–950° C. can be given by:

$$\theta_{\text{minimum}} = 1.1 \times 10^{-3} \exp\left[\left(\frac{13126}{1.987(t + 273)}\right)(P_{H2}/P_{H2O})^{0.667}\right] \quad (1)$$

The maximum treating time required to suppress the oxidation of the powder to 0.2% by weight or less can be given by:

$$\theta_{\text{maximum}} = \{0.101 \div (1.0 - 1.0038 \times 10^{-3}t)\}(P_{H2}/P_{H2O})^{1.341} \quad (2)$$

Regarding the ratio of $P_{H2}/P_{H2O}$, as is apparent from the graphs shown in FIGS. 2–7, satisfactory results are not obtained as long as the ratio is smaller than 0.5. On the other hand, when the ratio is over 1000, decarburization to a satisfactory level of carbon content requires a treating time longer than several hours even when the atmosphere temperature is raised. Thus, the purpose of this invention cannot be achieved.

Therefore, one of the critical conditions of this invention can be shown as follows:

Conditions (A):

Temperature (t°C.): 600° C.≦t≦950° C.

Atmosphere ($P_{H2}/P_{H2O}$): $0.5 \leqq P_{H2}/P_{H2O} \leqq 1000$

Treating time ($\theta$ min):

$$1.1 \times 10^{-3} \exp\left[\left(\frac{13126}{1.987(t+273)}\right)\left(\frac{P_{H2}}{P_{H2O}}\right)^{0.667}\right] \leqq$$

$$\theta \leqq \{0.101 \div (1.0 - 1.0038 \times 10^{-3}t)\}\left(\frac{P_{H2}}{P_{H2O}}\right)^{1.341}$$

In case where the temperature is over 950° C., the following critical conditions can be derived:

Atmosphere ($P_{H2}/P_{H2O}$): $P_{H2}/P_{H2O} \geqq 0.5$

Treating time ($\theta$ min):

$$\theta \geqq 1.1 \times 10^{-3} \exp\left(\frac{13126}{1.987(t+273)}\right)\left(\frac{P_{H2}}{P_{H2O}}\right)^{0.667}$$

However, when the temperature is excessively high, weilding of the particles will occur. The temperature should be limited to within a certain range.

Figure 8:
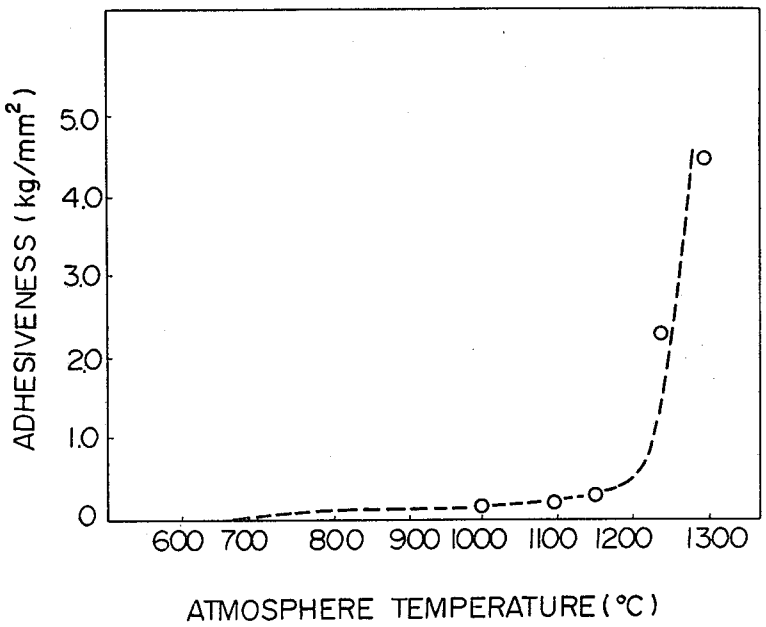
FIG. 8 is a graph showing the relationship between the temperature and the adhesiveness of particles.

FIG. 8 shows the relationship between the temperature and the adhesiveness of each particle. As is apparent from the graph, when the temperature goes up beyond 1250° C., the adhesive force between particles rapidly increases, resulting in welded particles, in which case a strong disintegrating force is required in a step following decarburization.

Thus, the following critical conditions can be defined at a temperature range of higher than 950° C. in accordance with this invention:

Temperature (t°C.): 950° C.<t≦1250° C.

Atmosphere ($P_{H2}/P_{H2O}$): $P_{H2}/P_{H2O} \geqq 0.5$

Treating Time ($\theta$ min):

$$\theta \geqq 1.1 \times 10^{-3} \exp\left(\frac{13126}{1.987(t+273)}\right)\left(\frac{P_{H2}}{P_{H2O}}\right)^{0.667}$$

In general, in a preferred embodiment of this invention the treating time of decarburization may be restricted to less than several hours, desirably less than approximately one hour from a practical viewpoint.

The thus decarburized steel powder is then cooled to room temperature in an inert or reducing atmosphere. The type of atmosphere is not limited to a specific one so long as the reoxidation can be prevented, but it is preferable to employ a dry hydrogen atmosphere.

Thus, according to the process of this invention, low-oxygen, low-carbon alloy steel produced in an efficient manner and in a continuous manner. The alloy steel of this invention includes high alloy steel as well as low alloy steel, as disclosed in the working examples hereinafter described.

It is herein to be noted that according to the process of this invention the processing condition range where the purpose of this invention has been achieved, e.g. Zones (II) in FIGS. 2–7 regarding decarburizing temperature, $P_{H2}/P_{H2O}$ ratio and treating time is wide. Therefore, according to this invention it is possible to continue decarburization regardless of fluctuation in processing conditions, which is usually experienced during operation. This means that a practical process for continuously producing decarburized alloy steel powder on an industrial scale can be provided in accordance with this invention.

TABLE 1

| | Chemical composition (% by weight) | | | | | | | | | | | Particle Size Distribution in mesh (% by weight) | | | | | | |
|---|---|---|---|---|---|---|---|---|---|---|---|---|---|---|---|---|---|---|
| Sample | C | Si | Mn | Cr | Ni | Mo | V | Nb | B | O | Fe | +60 | 60/100 | 100/150 | 150/200 | 200/250 | 250/350 | −350 |
| 1 | 0.47 | 0.01 | 1.07 | 1.08 | — | 0.42 | — | — | — | 0.04 | 96.8 | 3.5 | 6.1 | 9.5 | 15.8 | 8.6 | 17.1 | 40.0 |
| 2 | 0.50 | <0.01 | 0.80 | 0.80 | 1.00 | 0.23 | — | — | — | 0.05 | 96.5 | 8.8 | 7.9 | 10.2 | 13.7 | 7.7 | 14.6 | 37.1 |
| 3 | 0.50 | — | — | 4.0 | — | 5.0 | 2.5 | 1.0 | 0.08 | 0.02 | 86.8 | 3.9 | 5.5 | 8.6 | 13.2 | 8.4 | 16.2 | 44.2 |
| 4 | 0.42 | 0.1 | 12.0 | 2.0 | — | — | — | — | — | 0.03 | 85.3 | 5.4 | 8.4 | 12.2 | 15.4 | 7.2 | 17.1 | 34.3 |
| 5 | 0.30 | 0.05 | 1.8 | 19.2 | 9.5 | — | — | — | — | 0.05 | 68.4 | 2.8 | 7.7 | 13.4 | 7.7 | 19.0 | 29.2 | 20.1 |

NOTE: P,S < 0.03% by weight each

Figure 9:
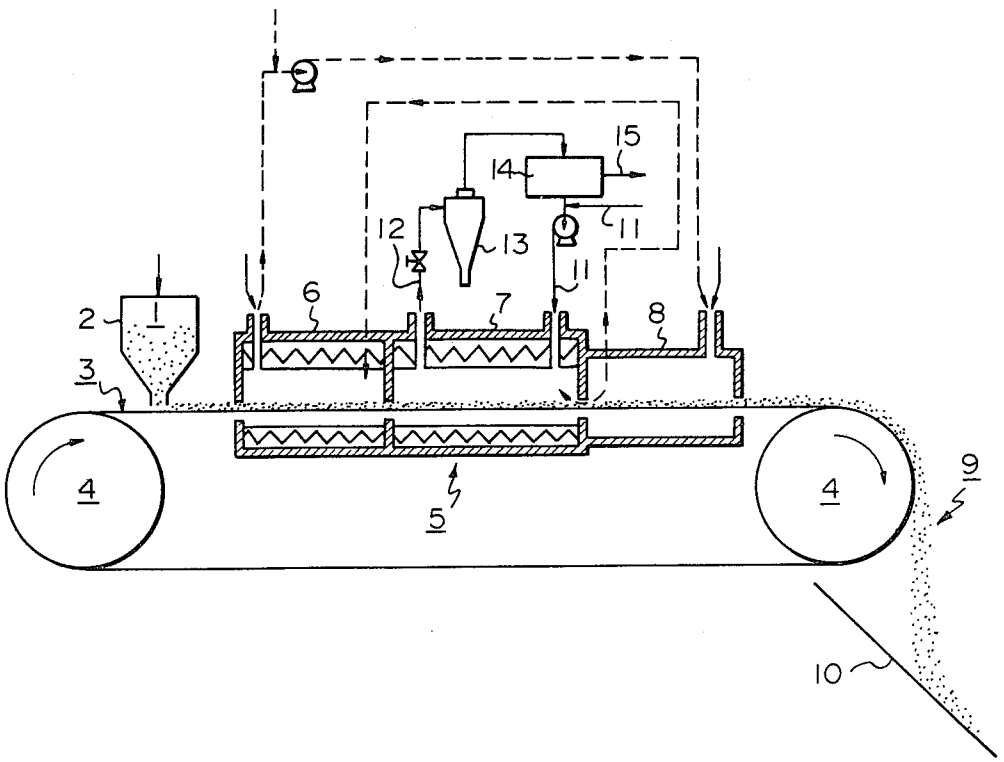
FIG. 9 is a diagrammatical view in section of a decarburization apparatus for carrying out the process of the invention.

The apparatus which is successfully employed for continuously carrying out the decarburization process of this invention will be described hereinafter FIG. 9 shows a diagrammatical view of a decarburizing appartus for carrying out this invention process, in which the steel powder 1 produced in the oil-atomizing step is first placed in a hopper 2 and then is continuously charged onto the steel belt 3 actuated by means of rollers 4. The steel belt 3 is successively passed through a decarburizing apparatus 5 which comprises a pre-heating chamber 6, a decarburizing chamber 7 and a cooling chamber 8. While the powder passes through the apparatus, the steel powder 1 is pre-heated, decarburized and then cooled, successively. After passing through the apparatus, the decarburized steel powder 9 is discharged out of the discharge end of the apparatus onto the chute.

A non-oxidizing gas ($H_2$ gas, for example) is supplied to the pre-heating chamber 6 and the cooling chamber 8 to keep the atmosphere non-oxidizing. The dotted lines in the drawing show the supply system of the non-oxidizing gas.

Gases ($H_2O$ and $H_2$) are supplied to the decarburizing chamber 7 to adjust the atmosphere. If necessary $N_2$ gas may also be supplied to the chamber through lines 11. These gases, each supplied through its respective supply system (not shown), will be combined in a gas-mixing tank (not shown) to adjust the gas composition prior to being supplied to the chamber. The gas discharged out of the chamber through line 12 is collected in a dust separator 13 where solids entrained with the gas is separated. Carbon oxides formed during decarburization is removed out of a gas-separator 14 through line 15. The recovered gas is then supplied to the decarburizing chamber through line 11. Further explanation on this gas supply system will be eliminated since the above explanation will be enough to the person skilled in the art.

Thus, in another preferred embodiment of this invention, the as-atomized alloy steel powder of this invention may be continuously carried on a conveyer through a decarburizing zone comprised of the decarburizing apparatus 5 where the as-atomized powder is continuously decarburized to a level of 0.1% by weight or less of carbon. The decarburizing zone may comprise a pre-heating section, a decarburizing section and a cooling section. The pre-heating and cooling sections are kept in an inert or reducing atmosphere.

This invention will further be described in conjunction with some working examples, which are presented merely for the purpose of illustrating this invention, not for limiting it at all.

EXAMPLE 1

In this example, Cr-Mn low alloy steel powder, which was produced through atomization using mineral oil as an atomizing agent, was subjected to decarburization using the decarburization apparatus shown in FIG. 9. The chemical composition and particle size distribution of the as atomized steel powder are shown in Table 2.

Decarburizing conditions are summarized in Table 3 and the chemical composition and particle size distribution of the thus decarburized steel powder are shown in Table 4.

As is apparent from the data shown in Table 4, according to the process of this invention it is possible to decarburize the atomized steel powder, i.e. to reduce carbon content from 0.5% by weight to 0.02% by weight in a very short period of time without resulting in substantial increase in oxygen content of the steel powder.

TABLE 2

| | Chemical Composition (% by weight) | | | | | | | | Particle Size Distribution in mesh (% by weight) | | | | | | |
|---|---|---|---|---|---|---|---|---|---|---|---|---|---|---|---|
| Sample | C | Si | Mn | Cr | Ni | Mo | O | Fe | +60 | 60/100 | 100/150 | 150/200 | 200/250 | 250/350 | −350 |
| A | 0.51 | <0.01 | 1.0 | 1.0 | — | 0.42 | 0.04 | 96.9 | 3.8 | 13.4 | 18.4 | 19.3 | 9.5 | 13.3 | 22.3 |
| B | 0.50 | <0.01 | 0.70 | 0.80 | 1.00 | 0.23 | 0.05 | 96.6 | 3.9 | 12.7 | 18.2 | 17.6 | 7.7 | 17.3 | 22.6 |
| C | 0.50 | 0.10 | 0.40 | 0.80 | 3.00 | — | 0.05 | 95.0 | 3.8 | 13.5 | 18.5 | 20.2 | 9.8 | 13.9 | 20.3 |

NOTE: P,S < 0.03% by weight each.

TABLE 3

| Conditions | |
|---|---|
| Amount of metal powder to be treated | 2.0 kg/charge |
| Heating temperature | 850° C. |
| Decarburizing gas composition | $H_2$ - 72.8% by volume<br>$H_2O$ - 2.9% by volume<br>$N_2$ - 24.3% by volume |
| Packed height | 4 mm |
| Treating period* | 5 min |

NOTE:
*Residence time in the decarburizing chamber

TABLE 4

| | Chemical Composition (% by weight) | | | | | | | | Particle Size Distribution in mesh (% by weight) | | | | | | |
|---|---|---|---|---|---|---|---|---|---|---|---|---|---|---|---|
| Sample | C | Si | Mn | Cr | Ni | Mo | O | Fe | +60 | 60/100 | 100/150 | 150/200 | 200/250 | 250/350 | −350 |
| A | 0.02 | <0.01 | 1.0 | 1.0 | — | 0.42 | 0.06 | 97.4 | 4.2 | 13.5 | 18.3 | 20.8 | 8.7 | 13.6 | 21.0 |
| B | 0.02 | <0.01 | 0.70 | 0.80 | 1.00 | 0.23 | 0.05 | 97.0 | 4.1 | 12.8 | 18.3 | 19.6 | 8.7 | 15.3 | 21.2 |
| C | 0.02 | 0.10 | 0.40 | 0.80 | 3.00 | — | 0.07 | 95.5 | 4.0 | 13.6 | 18.6 | 21.2 | 10.8 | 12.7 | 19.1 |

EXAMPLE 2

This example treats a low alloy steel powder which contains not only Cr and Mn, but also other easily oxidizable elements such as V, Nb, B and Si, etc. The steel powder having a chemical composition and particle size distribution shown in Table 5 was treated with the decarburizing apparatus shown in FIG. 9.

Decarburizing conditions are summarized in Table 6, and the chemical composition and particle size distribution of the thus decarburized steel powder are shown in Table 7.

As is apparent from the data shown in Table 7, according to this invention it is possible to decarburize the atomized alloy steel powder, i.e. to reduce the carbon content to 0.1% or less, while keeping the oxygen content at a substantially constant level of less than 0.1% by weight without adversely affecting the proportion of elements other than carbon, nor particle size distribution. The atomized powder employed in this example was produced through mineral oil atomization.

TABLE 5

| | Chemical Composition (% by weight) | | | | | | | | | | Particle Size Distribution in mesh (% by weight) | | | | | | |
|---|---|---|---|---|---|---|---|---|---|---|---|---|---|---|---|---|---|
| Sample | C | Si | Mn | Cr | Mo | V | Nb | B | O | Fe | +60 | 60/100 | 100/150 | 150/200 | 200/250 | 250/350 | −350 |
| D | 0.47 | 0.01 | 1.07 | 0.02 | <0.01 | 0.34 | — | — | 0.047 | 97.9 | 2.3 | 15.3 | 15.2 | 17.8 | 12.3 | 15.1 | 22.0 |
| E | 0.50 | — | — | 4.0 | 5.0 | 2.5 | 1.0 | 0.08 | 0.02 | 86.8 | 3.5 | 12.8 | 17.6 | 18.6 | 7.6 | 17.1 | 22.8 |
| F | 0.45 | 0.01 | 1.60 | — | — | — | 0.3 | — | 0.02 | 97.5 | 3.8 | 12.7 | 18.2 | 17.9 | 10.8 | 15.0 | 21.6 |
| G | 0.46 | 0.08 | 0.6 | 0.8 | — | — | — | 0.03 | 0.03 | 97.9 | 2.1 | 12.3 | 18.0 | 17.3 | 9.8 | 16.8 | 23.7 |

TABLE 5-continued

| Sample | Chemical Composition (% by weight) C | Si | Mn | Cr | Mo | V | Nb | B | O | Fe | Particle Size Distribution in mesh (% by weight) +60 | 60/100 | 100/150 | 150/200 | 200/250 | 250/350 | −350 |
|---|---|---|---|---|---|---|---|---|---|---|---|---|---|---|---|---|---|
| H | 0.30 | 0.20 | 0.8 | 1.0 | 0.2 | — | — | — | 0.02 | 97.4 | 3.7 | 14.2 | 17.8 | 19.1 | 8.2 | 16.1 | 20.9 |

NOTE: P, S < 0.03% by weight each.

TABLE 6

| Conditions | |
|---|---|
| Amount of metal powder to be treated | 2.0 kg/charge |
| Heating temperature | 900° C. |
| Decarburizing gas | $H_2$ - 98.0% by volume<br>$H_2O$ - 2.0% by volume<br>$N_2$ - — |
| Packed height | 4 mm |
| Treating period* | 10 min |

NOTE:
*Residence time in the decarburizing chamber

TABLE 7

| Sample | Chemical Composition (% by weight) C | Si | Mn | Cr | Mo | V | Nb | B | O | Fe | Particle Size Distribution in mesh (% by weight) +60 | 60/100 | 100/150 | 150/200 | 200/250 | 250/350 | −350 |
|---|---|---|---|---|---|---|---|---|---|---|---|---|---|---|---|---|---|
| D | 0.05 | 0.01 | 1.06 | 0.02 | <0.01 | 0.34 | — | — | 0.098 | 98.42 | 2.5 | 16.3 | 15.5 | 18.2 | 13.1 | 14.7 | 19.7 |
| E | 0.04 | — | — | 4.0 | 5.0 | 2.5 | 1.0 | 0.08 | 0.05 | 87.3 | 3.9 | 12.9 | 17.7 | 18.6 | 7.5 | 17.0 | 22.4 |
| F | 0.03 | <0.01 | 1.60 | — | — | — | 0.29 | — | 0.08 | 98.0 | 4.0 | 12.9 | 18.3 | 18.0 | 10.8 | 14.8 | 21.2 |
| G | 0.02 | 0.08 | 0.6 | 0.8 | — | — | — | 0.03 | 0.09 | 98.3 | 3.8 | 12.8 | 18.2 | 17.5 | 9.4 | 16.0 | 22.3 |
| H | 0.05 | 0.20 | 0.8 | 1.0 | 0.2 | — | — | — | 0.09 | 97.6 | 4.5 | 14.5 | 18.3 | 20.0 | 8.2 | 15.9 | 18.6 |

NOTE: P, S < 0.03% by weight each.

EXAMPLE 3

In this example stainless steel powder having chemical composition and particle size distribution as shown in Table 8 was subjected to decarburization using the decarburizing apparatus shown in FIG. 9.

The atomized steel powder employed in this example was produced by using mineral oil containing 5% by weight of water as an atomizing agent, and was characterized in that the carbon content of the steel is less than that of the powder used in Examples 1 and 2.

Decarburizing conditions are summarized in Table 9 and the chemical composition and particle size distribution of the thus decarburized stainless steel powder are shown in Table 10.

As is apparent from the data shown in Table 10, according to this invention it is possible to obtain stainless steel powder the carbon content of which has been reduced to 0.1% by weight while holding the oxygen content at a level of 0.2% by weight or less.

TABLE 8

| Sample | Chemical Composition (% by weight) C | Si | Mn | Cr | Ni | Mo | O | Fe | Particle Size Distribution in mesh (% by weight) +60 | 60/100 | 100/150 | 150/200 | 200/250 | 250/350 | −350 |
|---|---|---|---|---|---|---|---|---|---|---|---|---|---|---|---|
| I | 0.25 | 0.05 | 1.8 | 19.2 | 9.5 | — | 0.05 | 68.3 | 3.2 | 8.3 | 16.5 | 28.2 | 11.2 | 12.1 | 20.5 |
| J | 0.27 | 0.15 | 0.8 | 17.0 | 0.3 | — | 0.06 | 81.3 | 3.6 | 12.5 | 17.6 | 18.6 | 7.6 | 17.1 | 23.0 |
| K | 0.23 | 0.15 | 1.5 | 17.0 | 12.0 | 2.50 | 0.08 | 66.5 | 3.7 | 14.2 | 17.8 | 19.0 | 8.0 | 16.7 | 20.6 |

NOTE: P, S < 0.04% by weight each.

TABLE 9

| Conditions | |
|---|---|
| Amount of metal powder to be treated | 2.0 kg/charge |
| Heating temperature | 920° C. |
| Decarburizing gas composition | $H_2$ - 97.0% by volume<br>$H_2O$ - 3.0% by volume<br>$N_2$ - — |
| Packed height | 4 mm |
| Treating period* | 5 min |

NOTE:
*Residence time in the decarburizing chamber

TABLE 10

| Sample | Chemical Composition (% by weight) C | Si | Mn | Cr | Ni | Mo | O | Fe | Particle Size Distribution in mesh (% by weight) +60 | 60/100 | 100/150 | 150/200 | 200/250 | 250/350 | −350 |
|---|---|---|---|---|---|---|---|---|---|---|---|---|---|---|---|
| I | 0.05 | 0.05 | 1.8 | 19.2 | 9.5 | — | 0.11 | 69.2 | 4.2 | 8.4 | 17.5 | 28.2 | 10.9 | 11.1 | 19.7 |
| J | 0.05 | 0.15 | 0.8 | 17.0 | 0.3 | — | 0.12 | 81.5 | 3.0 | 12.7 | 18.6 | 18.7 | 7.6 | 16.8 | 22.6 |
| K | 0.05 | 0.15 | 1.5 | 17.0 | 12.0 | 2.5 | 0.14 | 66.6 | 4.1 | 14.9 | 18.3 | 19.0 | 7.7 | 16.3 | 19.7 |

The principles, preferred embodiments and modes of operation of this invention have been described in the foregoing specification. However, the invention which is intended to be protected is not to be construed as limited to the particular embodiments disclosed. The embodiments are illustrative, not restrictive. Variations and changes may be made by others without departing from the spirit of this invention. Accordingly, it is expressly intended that all variations and changes which fall within the spirit and scope of this invention as defined in the claims are to be embraced thereby.

We claim:

1. A process for producing low-oxygen, low-carbon alloy steel powder, which comprises the steps of:

preparing molten steel which contains at least one easily oxidizable element selected from the group consisting of chromium, manganese, vanadium, niobium, boron and silicon;

atomizing said molten steel by means of an atomizing agent containing a non-oxidizing medium to provide as-atomized alloy steel powder containing 0.2% by weight or less of oxygen and 0.1% by weight or more of carbon;

adjusting the amount of carbon of said as-atomized alloy steel powder by maintaining it in a decarburizing atmosphere containing at least $H_2$ and $H_2O$ gases under either of the below-defined conditions (A) or (B); and cooling the thus obtained alloy steel powder to room temperature in an inert or reducing atmosphere.

Condition (A):

Temperature (t°C.): 600° C.≦t≦950° C.

Atmosphere ($P_{H2}/P_{H2O}$): $0.5 \leqq P_{H2}/P_{H2O} \leqq 1000$

Treating Time ($\theta$ minute):

$$1.1 \times 10^{-3} \exp\left[\left(\frac{13126}{1.987(t+273)}\right)\left(\frac{P_{H2}}{P_{H2O}}\right)^{0.667}\right] \leqq \theta \leqq \{0.101 \div (1.0 - 1.0038 \times 10^{-3}t)\}\left(\frac{P_{H2}}{P_{H2O}}\right)^{1.341}$$

Condition (B):

Temperature (t°C.): 950° C.<t≦1250° C.

Atmosphere ($P_{H2}/P_{H2O}$): $P_{H2}/P_{H2O} \geqq 0.5$

Treating Time ($\theta$ minute):

$$\theta \geqq 1.1 \times 10^{-3} \exp\left(\frac{13126}{1.987(t+273)}\right)\left(\frac{P_{H2}}{P_{H2O}}\right)^{0.667}.$$

2. The process of claim 1, in which said non-oxidizing medium is selected from the group consisting of mineral oils, animal oils, vegetable oils and mixtures thereof.

3. The process of claim 1, in which said decarburizing atmosphere is comprised of $H_2$ and $H_2O$ gases.

4. The process of claim 1, in which said decarburizing atmosphere is comprised of $H_2$, $H_2O$ and $N_2$ gases.

5. The process of claim 3, in which the oxygen content of said as-atomized alloy steel powder is 0.1% by weight or less.

6. The process of claim 4, in which the oxygen content of said as-atomized alloy steel powder is 0.1% by weight or less.

7. The process of claim 5, in which the oxygen content of said as-atomized alloy steel powder is 0.05% by weight or less.

8. The process of claim 6, in which the oxygen content of said as-atomized alloy steel powder is 0.05% by weight or less.

9. A process for producing low-oxygen, low-carbon alloy steel powder, which comprises the steps of:

preparing molten steel which contains at least one easily oxidizable element selected from the group consisting of chromium, manganese, vanadium, niobium, boron and silicon;

atomizing said molten steel by means of an atomizing agent containing a non-oxidizing medium to provide as-atomized alloy steel powder containing 0.2% by weight or less of oxygen and 0.1% by weight or more of carbon;

continuously passing said as-atomized alloy steel powder through an atmosphere containing at least $H_2$ and $H_2O$ gases under either of the below-defined conditions (A) or (B) to adjust the amount of carbon of said as-atomized alloy steel powder; and cooling the thus obtained alloy steel powder to room temperature in an inert or reducing atmosphere.

Condition (A):

Temperature (t°C.): 600° C.≦t≦950° C.

Atmosphere ($P_{H2}/P_{H2O}$): $0.5 \leqq P_{H2}/P_{H2O} \leqq 1000$

Treating Time ($\theta$ minute):

$$1.1 \times 10^{-3} \exp\left[\left(\frac{13126}{1.987(t+273)}\right)\left(\frac{P_{H2}}{P_{H2O}}\right)^{0.667}\right] \leqq \theta \leqq \{0.101 \div (1.0 - 1.0038 \times 10^{-3}t)\}\left(\frac{P_{H2}}{P_{H2O}}\right)^{1.341}$$

Condition (B):

Temperature (t°C.): 950° C.<t≦1250° C.

Atmosphere ($P_{H2}/P_{H2O}$): $P_{H2}/P_{H2O} \geqq 0.5$

Treating Time ($\theta$ minute):

$$\theta \geqq 1.1 \times 10^{-3} \exp\left(\frac{13126}{1.987(t+273)}\right)\left(\frac{P_{H2}}{P_{H2O}}\right)^{0.667}.$$

10. The process of claim 9, in which said as-atomized alloy steel powder is continuously passed through a decarburizing zone comprised of a pre-heating section, a decarburizing section and a cooling section, said pre-heating and cooling sections being kept in an inert or reducing atmosphere.

11. The process of claim 9, in which said non-oxidizing medium is selected from the group consisting of mineral oils, animal oils, vegetable oils and mixtures thereof.

12. The process of claim 9, in which said decarburizing atmosphere is comprised of $H_2$ and $H_2O$ gases.

13. The process of claim 9, in which said decarburizing atmosphere is comprised of $H_2$, $H_2O$ and $N_2$ gases.

14. The process of claim 12, in which the oxygen content of said as-atomized alloy steel powder is 0.1% by weight or less.

15. The process of claim 13, in which the oxygen content of said as-atomized alloy steel powder is 0.1% by weight or less.

16. The process of claim 14, in which the oxygen content of said as-atomized alloy steel powder is 0.05% by weight or less.

17. The process of claim 15, in which the oxygen content of said as-atomized alloy steel powder is 0.05% by weight or less.

* * * * *